US009638179B2

(12) United States Patent
Sivaramakrishnan et al.

(10) Patent No.: US 9,638,179 B2
(45) Date of Patent: May 2, 2017

(54) HYDRAULIC CONTROL SYSTEM FOR A REVERSE OSMOSIS HYDRAULIC PUMP

(71) Applicant: General Electric Company, Schenectady, NY (US)

(72) Inventors: Shyam Sivaramakrishnan, Niskayuna, NY (US); Todd Alan Anderson, Niskayuna, NY (US); Matthew David D'Artenay, San Diego, CA (US); Robert Bruce Kingsley, Yakima, WA (US)

(73) Assignee: General Electric Company, Schenectady, NY (US)

( * ) Notice: Subject to any disclaimer, the term of this patent is extended or adjusted under 35 U.S.C. 154(b) by 430 days.

(21) Appl. No.: 13/693,762

(22) Filed: Dec. 4, 2012

(65) Prior Publication Data

US 2014/0154099 A1 Jun. 5, 2014

(51) Int. Cl.
*F04B 9/113* (2006.01)
*F04B 5/02* (2006.01)
(Continued)

(52) U.S. Cl.
CPC ..... *F04B 1/00* (2013.01); *F04B 5/02* (2013.01); *F04B 7/00* (2013.01); *F04B 9/113* (2013.01);
(Continued)

(58) Field of Classification Search
CPC .. F04B 5/02; F04B 7/00; F04B 7/0003; F04B 9/08; F04B 9/10; F04B 9/109;
(Continued)

(56) References Cited

U.S. PATENT DOCUMENTS 2,528,131 A * 10/1950 Garretson ..... 417/344
2,775,982 A 1/1957 Canfield
(Continued)

FOREIGN PATENT DOCUMENTS

CA 2657567 A1 3/2008
CH 586364 A5 3/1977
(Continued)

OTHER PUBLICATIONS

Childs, Willard D. and Ali Dabiri, VARI-RO™ Desalting Pilot Plant Testing and Evaluation, Final Technical Report, Science Applications International Corporation; San Diego CA; Water Treatment Technology Program; US Department of the Interior, Bureau of Reclamation, Untied States of America; May 1998.
(Continued)

*Primary Examiner* — Bryan Lettman
*Assistant Examiner* — Timothy Solak

(57) ABSTRACT

A liquid pumping system comprises a plurality of liquid pumps and a hydraulic drive unit. Each liquid pump is driven by a separate hydraulic cylinder. The hydraulic cylinders are powered by a shared hydraulic pump through a valve set. A valve set controller is configured to operate the valve set. A liquid pumping process comprises distributing an initial flow of pressurized hydraulic fluid between the hydraulic cylinders. The hydraulic cylinders move through a cycle in a phased relationship to provide a constant sum of flow rates from the liquid pumps. A membrane filtration system combines the liquid pumping system with a membrane unit. In a water treating process, feed water is pumped through the membrane unit. Brine from the membrane unit is returned to each liquid pump while that liquid pump is feeding water to the membrane unit.

12 Claims, 7 Drawing Sheets

(51) Int. Cl.

| | |
|---|---|
| ***F04B 49/06*** | (2006.01) |
| ***F04B 53/14*** | (2006.01) |
| ***F04B 7/00*** | (2006.01) |
| ***F04B 23/06*** | (2006.01) |
| ***F04B 17/00*** | (2006.01) |
| ***F04B 1/00*** | (2006.01) |

(52) U.S. Cl.
CPC ..... *F04B 17/00* (2013.01); *F04B 23/06* (2013.01); *F04B 49/065* (2013.01); *F04B 53/14* (2013.01)

(58) Field of Classification Search
CPC ..... F04B 9/113; F04B 9/1172; F04B 9/1174; F04B 23/04; F04B 49/005; F04B 49/065; F04B 1/00; F04B 9/111; F04B 11/005
See application file for complete search history.

(56) References Cited

U.S. PATENT DOCUMENTS

| | | | | |
|---|---|---|---|---|
| 2,915,042 | A | 12/1959 | Shafer | |
| 3,022,738 | A * | 2/1962 | Krute | 417/347 |
| 3,135,293 | A | 6/1964 | Hulsey | |
| 3,374,746 | A * | 3/1968 | Chenault | 417/403 |
| 3,685,536 | A | 8/1972 | Bake et al. | |
| 3,762,435 | A | 10/1973 | Auwerter | |
| 3,794,292 | A | 2/1974 | Jaegtnes | |
| 3,825,122 | A | 7/1974 | Taylor | |
| 3,833,200 | A | 9/1974 | McCombs, Jr. | |
| 3,941,154 | A | 3/1976 | Bishop | |
| 3,977,434 | A | 8/1976 | Albright et al. | |
| 4,009,860 | A | 3/1977 | Lingnau | |
| 4,016,083 | A | 4/1977 | Sakaguchi et al. | |
| 4,145,884 | A | 3/1979 | Childs | |
| 4,285,365 | A | 8/1981 | Coats et al. | |
| 4,434,056 | A | 2/1984 | Keefer | |
| 4,450,863 | A | 5/1984 | Brown | |
| 4,459,952 | A | 7/1984 | Holstein | |
| 4,526,340 | A | 7/1985 | Kolchinsky et al. | |
| 4,574,840 | A | 3/1986 | Schumann et al. | |
| 4,644,969 | A | 2/1987 | Watanabe | |
| 4,697,619 | A | 10/1987 | Tiefenthaler | |
| 4,705,627 | A | 11/1987 | Miwa et al. | |
| 4,724,866 | A | 2/1988 | Bates et al. | |
| 4,838,145 | A | 6/1989 | Slocum et al. | |
| 4,913,809 | A * | 4/1990 | Sawada et al. | 210/98 |
| 5,154,820 | A | 10/1992 | Solomon | |
| 5,222,873 | A | 6/1993 | Whitehead et al. | |
| 5,339,857 | A | 8/1994 | Scallan et al. | |
| 5,350,047 | A | 9/1994 | Kimura et al. | |
| 5,476,222 | A | 12/1995 | Singer et al. | |
| 5,542,384 | A | 8/1996 | Rosenmann et al. | |
| 5,628,198 | A | 5/1997 | Permar | |
| 5,634,779 | A * | 6/1997 | Eysymontt | 417/342 |
| 5,645,263 | A | 7/1997 | Aardema | |
| 5,967,108 | A | 10/1999 | Kutlucinar | |
| 6,017,200 | A * | 1/2000 | Childs | B01D 61/06 417/390 |
| 6,135,724 | A * | 10/2000 | Yoder | F04B 9/113 222/63 |
| 6,205,780 | B1 | 3/2001 | Zervas | |
| 6,244,838 | B1 * | 6/2001 | Couillard et al. | 417/426 |
| 6,263,905 | B1 | 7/2001 | Yokota et al. | |
| 6,266,598 | B1 | 7/2001 | Pillar et al. | |
| 6,267,571 | B1 | 7/2001 | Anderson et al. | |
| 6,468,831 | B2 | 10/2002 | Leong et al. | |
| 6,470,683 | B1 | 10/2002 | Childs et al. | |
| 6,491,813 | B2 | 12/2002 | Verde | |
| 6,623,254 | B2 | 9/2003 | Chowaniec et al. | |
| 6,652,741 | B1 | 11/2003 | Marinzet | |
| 6,708,489 | B2 | 3/2004 | Massey et al. | |
| 6,773,226 | B2 | 8/2004 | Al-Hawaj | |
| 6,841,076 | B1 * | 1/2005 | Wobben | B01D 61/06 210/258 |
| 7,000,379 | B2 | 2/2006 | Makki et al. | |
| 7,032,388 | B2 | 4/2006 | Healy | |
| 7,152,620 | B2 | 12/2006 | Baumgarten et al. | |
| 7,168,927 | B2 | 1/2007 | Brueckmann et al. | |
| 7,415,937 | B2 | 8/2008 | Giesler et al. | |
| 7,540,230 | B2 | 6/2009 | Rojanskiy et al. | |
| 7,634,911 | B2 | 12/2009 | Brinkman | |
| 7,753,072 | B2 | 7/2010 | Douglas et al. | |
| 7,757,714 | B2 | 7/2010 | Meinhof | |
| 7,905,088 | B2 | 3/2011 | Stephenson et al. | |
| 7,927,082 | B2 | 4/2011 | Haudenschild | |
| 8,186,154 | B2 | 5/2012 | Nelson et al. | |
| 2001/0017278 | A1 * | 8/2001 | Verde | 210/321.66 |
| 2002/0000648 | A1 | 1/2002 | Leong et al. | |
| 2002/0134441 | A1 | 9/2002 | Kusumoto et al. | |
| 2003/0024239 | A1 | 2/2003 | Massey et al. | |
| 2003/0116122 | A1 | 6/2003 | Haeberer et al. | |
| 2003/0118459 | A1 | 6/2003 | Gerhardt et al. | |
| 2005/0062000 | A1 | 3/2005 | Bartell, Jr. et al. | |
| 2005/0123416 | A1 | 6/2005 | Smith | |
| 2006/0071189 | A1 | 4/2006 | Cornwell et al. | |
| 2007/0045069 | A1 * | 3/2007 | Schedgick | B62D 33/0608 188/378 |
| 2007/0128056 | A1 | 6/2007 | Haudenschild | |
| 2007/0246678 | A1 | 10/2007 | Michaels | |
| 2010/0063494 | A1 | 3/2010 | Orszulak | |
| 2010/0154401 | A1 * | 6/2010 | Sullivan, Jr. | E02F 9/2235 60/444 |
| 2010/0301252 | A1 | 12/2010 | Myran et al. | |
| 2011/0017310 | A1 | 1/2011 | Eriksson | |
| 2011/0077783 | A1 | 3/2011 | Karpman et al. | |
| 2011/0198290 | A1 | 8/2011 | Oklejas | |
| 2012/0067432 | A1 | 3/2012 | Vigholm et al. | |
| 2012/0118810 | A1 | 5/2012 | Giles et al. | |
| 2014/0154099 | A1 | 6/2014 | Sivaramakrishnan et al. | |

FOREIGN PATENT DOCUMENTS

| | | | |
|---|---|---|---|
| CN | 2716251 | Y | 8/2005 |
| CN | 1721047 | A | 1/2006 |
| CN | 2926197 | Y | 7/2007 |
| DE | 2444740 | A1 | 4/1976 |
| DE | 102007033498 | A1 | 1/2009 |
| DE | 102008011982 | A1 | 9/2009 |
| EP | 0292267 | A2 | 11/1988 |
| GB | 2356432 | A | 5/2001 |
| JP | 2005195081 | A | 7/2005 |
| JP | 2010063976 | A | 3/2010 |
| WO | 9119676 | A1 | 12/1991 |
| WO | 03051598 | A1 | 6/2003 |
| WO | 2007146321 | A1 | 12/2007 |
| WO | 2009151174 | A1 | 12/2009 |
| WO | 2010030723 | A1 | 3/2010 |
| WO | 2012085326 | A1 | 6/2012 |

OTHER PUBLICATIONS

Denison Hydraulics, GoldCup Digital Hi-IQ Control, Electronic Control Card User Manual Software Version 2.2b, Jun. 4, 2002.

Search Report and Written Opinion from PCT Application No. PCT/US2012/055695 dated Dec. 12, 2012.

Sanz, Miguel Angel, Energy as Motor of Seawater Reverse Osmosis Desalination Development, WISA Membrane Technology Conference 2011, Sep. 11-14, 2011, Umhlanga, South Africa.

Bross, Stephan et al., SWRO core hydraulic system: Extension of the SalTec DT to higher flows and lower energy consumption, Desalination 203 (2007) 160-167.

Search Report and Written Opinion from PCT Application No. PCT/US2012/057813 dated Jan. 4, 2013.

Childs, Willard D., et al., Energy and Capital Cost Savings with a Highly Efficient Integrated Pumping and Energy Recovery System, IDA World Congress—Atlantis, The Palm—Dubai, UAE, Nov. 7-12, 2009.

Fluid Power Lecture Notes, accessed at http://paws.wcu.edu/ballaaron/www/met441/notes/notes.html on Jul. 3, 2013, Figures 4 and 5, p. 9.

(56) References Cited

OTHER PUBLICATIONS

International Search Report and Written Opinion issued in connection with corresponding PCT Application No. PCT/US2013/071834 on Mar. 17, 2014.
International Search Report & Written opinion dated Mar. 17, 2014, issued against related PCT application No. PCT/US2013/071381.
Office Action dated Mar. 30, 2015, issued against related Chinese application No. 201280047732.5.
Office Action dated Jan. 22, 2015, issued against related U.S. Appl. No. 13/250,463.
International Search Report and Written Opinion dated Mar. 17, 2014, issued against related PCT Application No. PCT/US2013/071834.
Office Action dated Nov. 4, 2015, issued against related U.S. Appl. No. 13/250,674.
Childs et al., "VARI-RO Direct Drive Engine Study", Science Applications International Corporation, pp. 1-54, 1998.
Stover, "Energy Recovery Devices for Seawater Reverse Osmosis", Everything About Water, pp. 40-46, 2006.
Sun et al., "Energy Recovery Device with a Fluid Switcher for Seawater Reverse Osmosis System", Chinese Journal of Chemical Engineering, vol. 16, Issue 2, pp. 329-332, 2008.
Contreras, "An Energy Recovery Device for Small-Scale Seawater Reverse Osmosis Desalination", A Doctoral Thesis, Submitted in partial Fulfilment of the Requirements, for the Award of Doctor of Philosophy of Loughborough University, pp. 1-146, Dec. 9, 2009.
"GE Introduces Major Energy Efficiency Breakthrough for Desalination Plants", General Electrical, 2012.
PCT Search Report and Written Opinion issued in connection with related PCT Application No. PCT/US2013/071829 on Mar. 17, 2014.
Unofficial English translation of Chinese Office Action issued in connection with related CN Application No. 201280047713.2 on Feb. 9, 2015.
Non-Final Office Action issued in connection with related U.S. Appl. No. 13/711,966, filed Sep. 2, 2015.
Non-Final Office Action issued in connection with related U.S. Appl. No. 13/693,743, filed Dec. 18, 2015.
Final Office Action issued in connection with related U.S. Appl. No. 13/711,966, filed Feb. 16, 2016.
Non-Final Office Action issued in connection with related U.S. Appl. No. 13/250,674, filed Mar. 2, 2016.
Office Action dated Mar. 2, 2016, issued on corresponding U.S. Appl. No. 13/250,674.
Office Action dated Dec. 18, 2015, issued on corresponding U.S. Appl. No. 13/693,743.
US Final Office Action issued in connection with Related U.S. Appl. No. 13/693,743, filed Jun. 28, 2016.
US Non-Final Office Action issued in connection with Related U.S. Appl. No. 13/250,674, filed Jul. 20, 2016.
Willard D. Childs, filed Sep. 30, 2011, U.S. Appl. No. 13/250,674.
Matthew D. d'Artenay et al., filed Sep. 30, 2011, U.S. Appl. No. 13/250,463.
Shyam Sivaramakrishnan et al., filed Dec. 12, 2012, U.S. Appl. No. 13/711,966.
Dean David Marschke, filed Dec. 4, 2012, U.S. Appl. No. 13/693,743.

* cited by examiner

HYDRAULIC CONTROL SYSTEM FOR A REVERSE OSMOSIS HYDRAULIC PUMP

FIELD

This invention relates to devices and processes for pumping liquids with energy recovery; to membrane filtration, for example by reverse osmosis; and to desalination.

BACKGROUND

Many areas of the world do not have adequate fresh water supplies but they are near seawater. Seawater can be desalinated using reverse osmosis (RO). During RO, the feed water must be pressurized above the osmotic pressure of the feed water. The feed water becomes concentrated during this process and its osmotic pressure increases. Feed water pressures for seawater reverse osmosis (SWRO) are typically in a range of 50-70 bar (approximately 725 psi to 1015 psi).

Pressurizing the seawater in an RO system consumes energy. One approach to reduce energy consumption is to recover energy from the residual pressure of the brine after it leaves an RO module. An energy recovery pumping system is described by Childs et al. in U.S. Pat. No. 6,017,200 entitled "Integrated Pumping and/or Energy Recovery System." This approach uses multiple water cylinders moving in a phased relationship to provide pressurized feed water to a RO membrane unit. One side of a piston in the water cylinder drives the feed water to the RO membrane unit while the other side of the piston receives brine from the RO membrane unit. The pressure of the brine reduces the power required to move the piston. Each water cylinder is connected to a separate hydraulic pump and hydraulic cylinder combination to move the piston in the water cylinder according to a desired velocity profile and to provide the additional energy required to pressurize the feed water.

U.S. patent application Ser. No. 13/250,463, entitled "Energy Recovery Desalination", by D'Artenay et al. describes an energy recovery pumping system that makes various improvements to the Childs et al. system. For example, each of the hydraulic pumps has an adjustable swash plate to change the rate and direction of hydraulic fluid flow to its associated hydraulic cylinder. Inner and outer control loops are used to modify the position of the swash plate so that the water cylinder connected to the hydraulic cylinder follows an intended velocity profile more closely.

SUMMARY

A liquid pumping system is described in this specification that comprises a plurality of liquid pumps and a hydraulic drive unit. Each liquid pump is driven by a separate hydraulic cylinder. The hydraulic cylinders are powered by a shared hydraulic pump through a valve set. The valve set is operated by a valve set controller. The valve set controller is configured to distribute a flow of hydraulic fluid from the hydraulic pump between the hydraulic cylinders such that the liquid pumps operate in a phased relationship to each other. Preferably, the total liquid flow produced from the liquid pumps is generally constant over a period of time in which the hydraulic pump produces a generally constant output. Optionally, the valve set may comprise a set of valves, for example a proportional directional control valve for each hydraulic cylinder, connected in parallel to the hydraulic pump.

A membrane filtration system is described in this specification that uses the liquid pumping system to provide feed water to a membrane unit. A water circuit is configured such that each liquid pump receives pressurized brine from the membrane unit while pumping water. The membrane unit may be a reverse osmosis unit.

Processes are described in this specification for pumping a liquid and for treating water. The liquid pumping process comprises a step of providing an initial flow of pressurized hydraulic fluid. The initial flow of pressurized hydraulic fluid is distributed between a plurality of hydraulic cylinders such that, over a period of time in which the initial flow is essentially constant, the sum of the distributed flows is also essentially constant but the hydraulic cylinders move in a phased relationship to each other. Each hydraulic cylinder drives a liquid pump. In the water treating process, water is pumped to a membrane unit. Brine from the membrane unit is provided to each liquid pump while that liquid pump is feeding water to the membrane unit. Preferably, the liquid pumps produce a generally constant flow of feed water to the membrane unit. Optionally, the membrane unit may be a reverse osmosis unit.

The processes and systems provide useful alternative ways and means for pumping liquids or treating water. In at least some cases, the processes and systems may provide one or more benefits relative to the systems described by Childs et al. and D'Artenay et al., or other high pressure pumping systems with energy recovery, such as reduced energy consumption, reduced parts count or cost, or reduced maintenance. Without limitation, the processes and systems may be used in the desalination industry.

DETAILED DESCRIPTION

Figure 1:
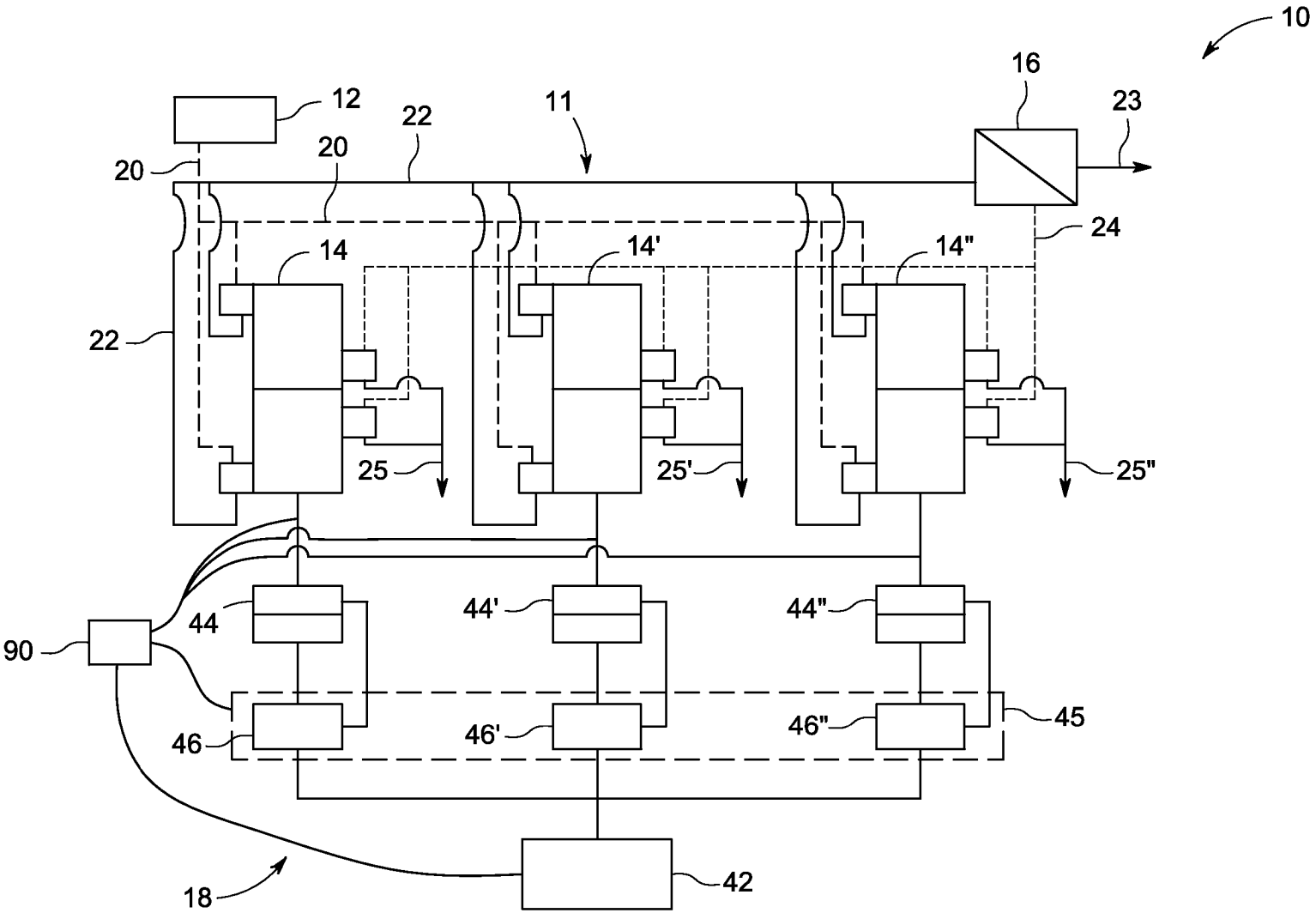
FIG. 1 is a schematic diagram of a water treatment system having a pumping system combined with a membrane unit.

FIG. 1 shows a system 10 for treating water. The system 10 comprises a feed water source 12, a pumping system 11 and a membrane unit 16, for example a reverse osmosis unit. The pumping system 11 provides feed water from the source 12 to the membrane unit 16, preferably at a high pressure and generally constant flow rate. The flow rate may be varied by an operator from time to time. However, the flow rate is constant in the sense that it is generally the same as a fixed reference value, for example within about 10% of the reference value, for a period of time. During the period of time, which may be an hour or more, the components of the pumping system 11 may move through many, for example 10 or more or 100 or more, cycles.

The pumping system 11 has two or more water cylinders 14 and a hydraulic drive unit 18. The water cylinders 14, and the valves and conduits of a water circuit connecting them to the membrane unit 16, may be similar to those described in U.S. Pat. No. 6,017,200, entitled "Integrated Pumping and/or Energy Recovery System", U.S. patent application Ser. No. 13/250,463 entitled "Energy Recovery Desalination" and U.S. patent application Ser. No. 13/250,674 entitled "Valve System for Pressure Recovery in IPER", which are incorporated herein by reference. The pumping system 11 shown has three water cylinders 14 but alternatively there may be two, three, four or other numbers of water cylinders 14. Alternatively, other types of water pumps may be used in place of the water cylinders 14. The pumping system 11 may also be used to pump other liquids.

Feed water, for example seawater, brackish water, groundwater, boiler feed water or wastewater, flows from the feed water source 12 to the water cylinders 14 via low pressure feed pipes 20. The feed water is pressurized within the water cylinders 14 and directed to the membrane unit 16 via high pressure feed pipes 22. Each water cylinder 14 goes through approximately the same cycle but the cycles have a phased relationship to each other such that at any given point in time each water cylinder 14 is in a different part of its cycle.

The membrane unit 16 separates the feed water into a low pressure stream of low-solute permeate and a high pressure stream of high-solute brine, alternatively called concentrate or retentate. The permeate is withdrawn from the membrane unit 16 for various uses, for example drinking water, through permeate pipe 23. The brine is directed back to the water cylinders 14, via high pressure brine pipes 24. Each water cylinder 14 receives brine while providing feed water such that the pressure of the brine can be used to help pressurize the feed water. Low-pressure brine, after being used to help generate feed water pressure, is directed from the water cylinder 14 for waste, recycling or reuse via low pressure brine pipes 25. The water cylinders 14 are dual acting pumps that pump feed water on both a forward and a reverse stroke.

Variations of the system 10 may have two, three or more single acting or dual acting water cylinders 14. The description immediately below will focus on one water cylinder 14 and the movement of a single reciprocating assembly 26 that is part of the water cylinder 14. However, other parts of the description and figures may refer to a particular water cylinder 14, 14', 14" or to a set of the water cylinders 14, 14', 14".

Figure 1A:
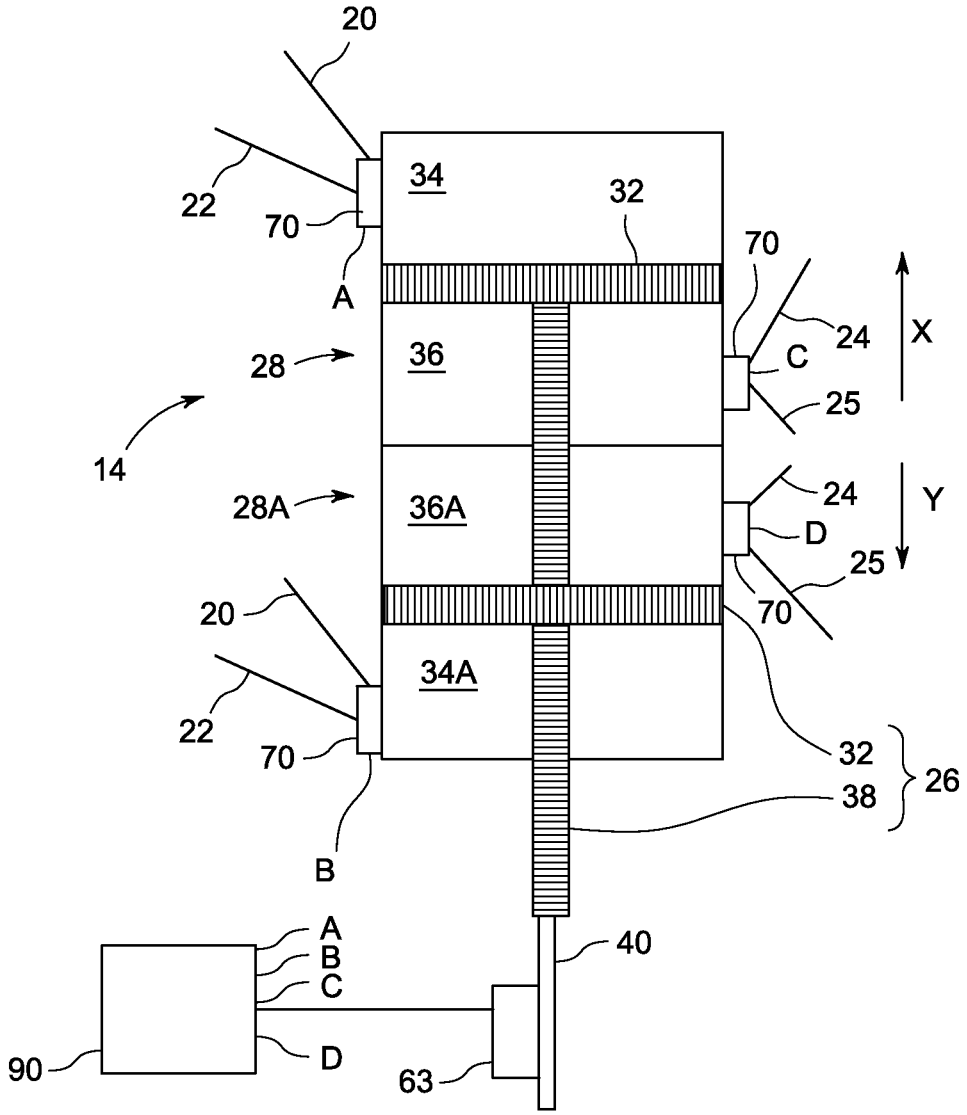
FIG. 1A is a schematic diagram of a water cylinder for use with the system of FIG. 1.

Referring to FIG. 1A, each water cylinder 14 has a first and a second water piston chamber 28, 28A. In the example of FIG. 1A, the water piston chambers 28, 28A are located in a single housing, but alternatively they may be located in separate housings. Each water piston chamber 28, 28A has a water piston 32. The water pistons 32 separate the water piston chambers 28, 28A into feed water working chambers 34 and concentrate working chambers 36. Each water cylinder 14, therefore, has first and second feed water working chambers 34, 34A and a first and a second concentrate working chambers 36, 36A. Preferably, the feed water working chambers 34, 34A are at the ends of the water cylinder 14 and the concentrate working chambers 36, 36A are at the middle of the water cylinder 14. Optionally, other configurations of water cylinder 14 may be used.

The water pistons 32 are mechanically coupled to each other by a connecting rod 38. The connecting rod 38 extends through a dividing wall between the concentrate working chambers 36, 36A and out of the water cylinder 14 through bearing and seal assemblies (not shown), which minimize or prevent pressure or fluid leaks. The connecting rod 38 and the dual-acting pistons 32 are collectively referred to as the reciprocating assembly 26.

Figure 1B:
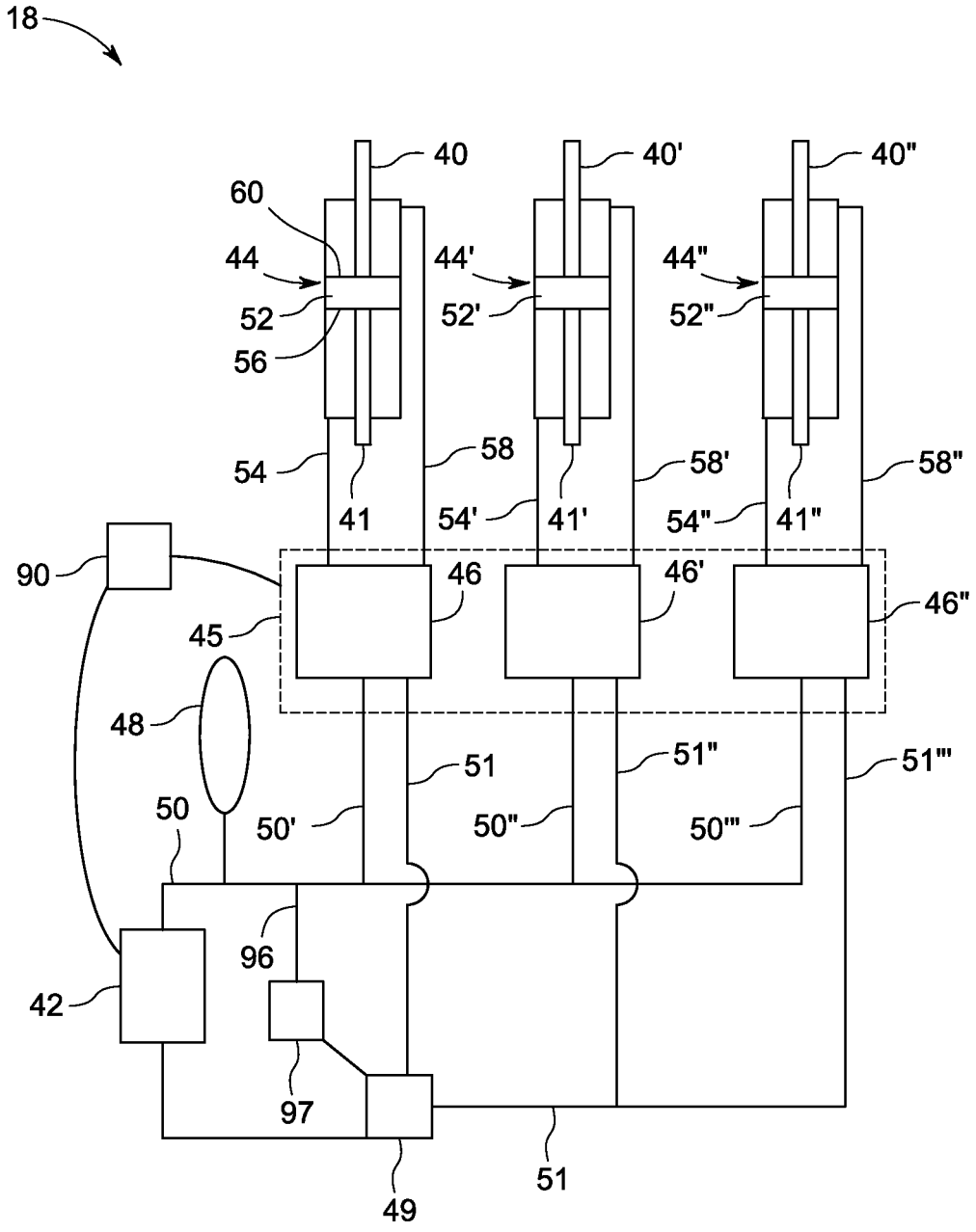
FIG. 1B is a schematic diagram of a hydraulic delivery unit for use with the system of FIG. 1.

The reciprocating assembly 26 is connected to a piston rod 40 of a hydraulic piston 52 (see FIG. 1B). In the example of FIG. 1, the piston rod 40 and the reciprocating assembly 26 move in unison and have the same acceleration, the same velocity and the same direction of travel during the same period of time. Alternatively, other connections may be provided between the piston rod 40 and the reciprocating assembly 26 such that there is a transformation between the movement of the piston rod 40 and the reciprocating assembly 26. For example, the piston rod 40 and the reciprocating assembly 26 may be connected by a gear set, lever or hydraulic transducer such that the reciprocating assembly 26 moves through a shorter or longer stroke or in a reverse direction relative to the piston rod 40.

Each water cylinder 14 comprises water cylinder valves 70 that control the flow of liquid into and out of the water cylinders 14. Opening and closing of the water cylinder valves 70 is controlled by a controller 90 in association with the movement of the reciprocating assembly 26. Optionally, the water cylinder valves 70 may be similar to those described in U.S. Pat. No. 6,017,200, entitled "Integrated Pumping and/or Energy Recovery System", U.S. patent application Ser. No. 13/250,463 entitled "Energy Recovery Desalination" and U.S. patent application Ser. No. 13/250,674 entitled "Valve System for Pressure Recovery in IPER".

While the reciprocating assembly 26 moves forwards, or upwards as it is oriented in FIG. 1A, the water cylinder valves 70 are configured such that: feed water in the upper working chamber 34 flows out to a high pressure feed pipe 22; brine flows into the upper concentrate working chamber 36 from a high pressure brine pipe 24; water flows out of the lower concentrate working chamber 36A to a low pressure brine pipe 25; and, feed water flows into the lower feed water working chamber 34A from a low pressure feed pipe 20. While the reciprocating assembly 26 moves in reverse, or downwards as it is oriented in FIG. 1A, the water cylinder valves 70 are configured such that: feed water flows into the upper working chamber 34 from a low pressure feed pipe 20; brine flows out of the upper concentrate working chamber 36 to a low pressure brine pipe 25; water flows into the lower concentrate working chamber 36A from a high pressure brine pipe 24; and, feed water flows out of the lower feed water working chamber 34A to a high pressure feed pipe 22. The water cylinder valves 70 are re-configured near or during dwell periods between forward and reverse movements of the reciprocating assembly 26. In this way, energy is recovered from the pressurized brine to help provide pressurized feed water to the membrane unit 16.

FIG. 1B shows the hydraulic drive unit 18. The hydraulic drive unit 18 has a hydraulic pump 42, two or more hydraulic cylinders 44, a valve set 45 and a controller 90. Optionally, the valve set 45 may have a control valve 46 for each hydraulic cylinder 44. Each hydraulic cylinder 44 has a hydraulic piston 52 connected to a piston rod 40. Referring to FIG. 1A, each piston rod 40 is connected to the reciprocating assembly 26 of a water cylinder 14.

The hydraulic piston 52 optionally includes an extension 41 that extends from the first side 56 of the hydraulic piston 52. The extension 41 preferably has a different cross-sectional area than the piston rod 40. In particular, the extension 41 may have a smaller cross-sectional area than the piston rod 40. The first side 56 and the second side 60 of the hydraulic piston 52 preferably have different surface areas. In particular, the first side 56 of the hydraulic piston 52 preferably has a larger surface area than the second side 60. For example, the ratio of the surface areas of the first and second side 56, 60 may be within about 10% of the ratio of the forces acting on the water pistons 32 as they move in the forward and reverse directions within the water cylinder 14. The ratio of forces is calculated by equation (1) below and it is equal to the piston surface area within the first feed water working chamber 34 (PSA 34) subtracted by the piston surface area within the first concentrate working chamber 36 (PSA 36) relative to the piston surface area within the second feed water working chamber 34A (PSA 34A) subtracted by the piston surface area within the second concentrate working chamber 34A (PSA 34A):

$$\text{Ratio of forces}=(PSA\ 34-PSA\ 36):(PSA\ 34A-PSA\ 36A) \quad (1).$$

The ratio of forces can be within a range of about 1:1 to about 1.25:1. The ratio of hydraulic piston 52 surface areas is selected to help balance a pressure differential that arises between the hydraulic cylinders 44, 44', 44" resulting from the connecting rod 38 extending through the second feed water working chamber 34A but not the first feed water working chamber 34. Alternatively, but not preferably, the connecting rod 38 may be extended through the first feed water working chamber 34.

If the extension 41 is not included, optionally the piston rod 40 may be re-sized to ensure that the ratio of hydraulic piston 52 surface areas is still within 10% of the ratio of forces acting on the water pistons 32. If this results in piston rod 40 being too small to withstand the hydraulic forces, the surface areas of the water pistons 32 can be modified to ensure that a sufficiently large piston rod 40 diameter is used while simultaneously providing the desired ratio of the hydraulic piston 52 surface areas.

Over a period of time, for example an hour or more, when a generally constant flow of feed water to the membrane unit 16 is desired, the hydraulic pump 42 is operated at a generally constant output. The hydraulic pump 42 provides a generally constant flow of hydraulic fluid at a generally constant pressure through supply pipes 50 to the valve set 45. The hydraulic pump 42 may be one of a number of variable displacement pumps, including but not limited to: axial piston pumps, bent axis pumps and pressure compensated variable displacement pumps. Alternatively, the hydraulic pump 42 may be one of a number of fixed displacement pumps, including but not limited to: rotary vane pumps, piston pumps and diaphragm pumps, with a motor that may be controlled by a variable frequency drive unit. Return pipes 51 conduct hydraulic fluid returning from the valve set 45 to a hydraulic fluid reservoir 49. Optionally, a filter may be provided in the return pipes 51.

Optionally, the hydraulic pump 42 may supply hydraulic fluid to the valve set 45 through an accumulator 48 to accommodate temporary pressure increases or decreases in the supply pipes 50. Optionally, the hydraulic drive unit 18 may further comprise a pressure relief loop 96 with a pressure relief valve 97. The pressure relief loop 96 connects the supply line 50 to the hydraulic fluid reservoir 49. The pressure relief valve 97 opens if pressure in the supply line 50 exceeds a pre-set pressure indicating a failure in the hydraulic drive unit 18 or the pumping system 11.

For each hydraulic cylinder 44, a forward feed pipe 54 connects the valve set 45 to a chamber of the hydraulic cylinder 44 in communication with the first side 56 of the hydraulic piston 52. A reverse feed pipe 58 connects the valves set 45 to another chamber of the hydraulic cylinder 44 in communication with and a second side 60 of the hydraulic piston 52.

The valve set 45 receives a generally constant flow of hydraulic fluid from the hydraulic pump 42 and distributes the hydraulic fluid between the hydraulic cylinders 44. For example, in relation to each hydraulic cylinder 44, the valve set 45 may direct pressurized hydraulic fluid to the first side 56 of the hydraulic piston 52 or to the second side 60 of the hydraulic piston 52, or the valves set 45 may stop the flow of hydraulic fluid to the hydraulic cylinder 44. The valve set 45 may also return hydraulic fluid from the hydraulic cylinder 44 to the hydraulic fluid reservoir 49. The valve set 45 may be configured such that low pressure returning hydraulic fluid flows through the same, or a different, valve body that the pressurized hydraulic fluid flows through.

Optionally, the valve set 45 may comprise a separate control valve 46 for each hydraulic cylinder 44. The control valve 46 may be, for example, one or more servo valves, preferably with actuator feedback. Alternatively, the control valve 46 may be one or more four-way, proportional directional control valves. Table 1 below provides a summary of some of the available positions of a four-way, proportional directional control valve 46. Each control valve 46 is able to transition between position 1 and position 2 and between position 2 and position 3. The individual control valves 46 in the valve set 45 are operated in a phased relationship to each other. However, operation of the control valves 46 is coordinated such that the sum of the flow rates of pressurized hydraulic fluid to forward feed pipes 54 and reverse feed pipes 58, which is essentially the same as the sum of the flow rates in the individual supply pipes 50', 50" and 50'", is essentially constant over a period of time in which the flow rate in the supply pipe 50 is essentially constant. The operation of the control valves 46 can also be coordinated to minimize pressure losses across each control valve 46. This is achieved by directing a position profile of each control valve 46 to closely follow the shape of a velocity profile 138 of the associated water piston 32, as described further below. In Table 1, positions 1 and 3 represent nominal fully open positions. However, these positions may be partially open, for example 80% to 98% open, positions in the physical valves to allow for a controller to correct errors by temporarily more fully opening a valve, as will be described further below.

TABLE 1

| | Position 1 | Position 2 | Position 3 |
|---|---|---|---|
| Supply pipe 50 | OPEN to forward feed pipe 54 | CLOSED | OPEN to reverse feed pipe 58 |
| Return pipe 51 | OPEN to reverse feed pipe 58 | CLOSED | OPEN to forward feed pipe 54 |

Preferably, the control valve 46 has a controllable transition speed between the three positions. Preferably, the rate of flow through the valve while transitioning or at a certain time is a known or determinable function of the location of control valve 46 between positions. Optionally, a throttle valve may be integrated with the control valve 46 to vary the flow rate through the control valve in position 1 or position 3. However, it is typically more energy efficient to control flow rate in position 1 or position 3 by varying the output of the hydraulic pump 42.

Figure 1C:
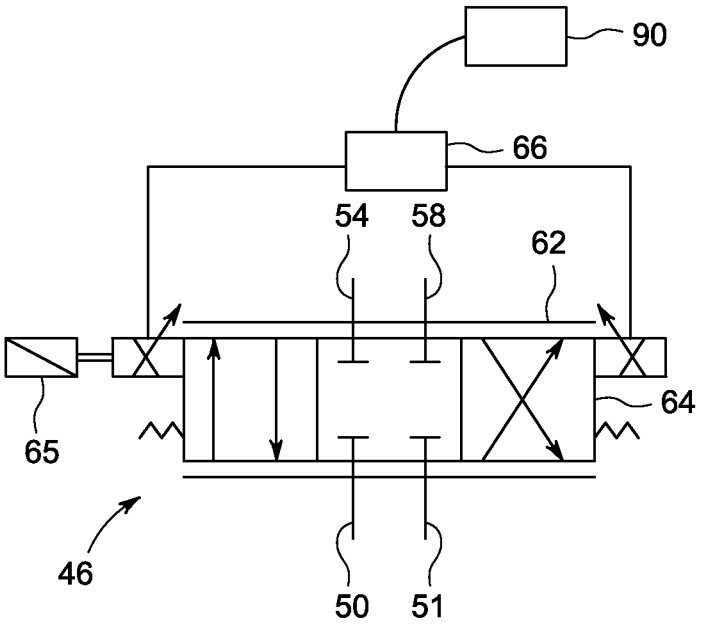
FIG. 1C is a schematic diagram of a control valve for use with the hydraulic delivery unit of FIG. 1B.
Figure 1D:
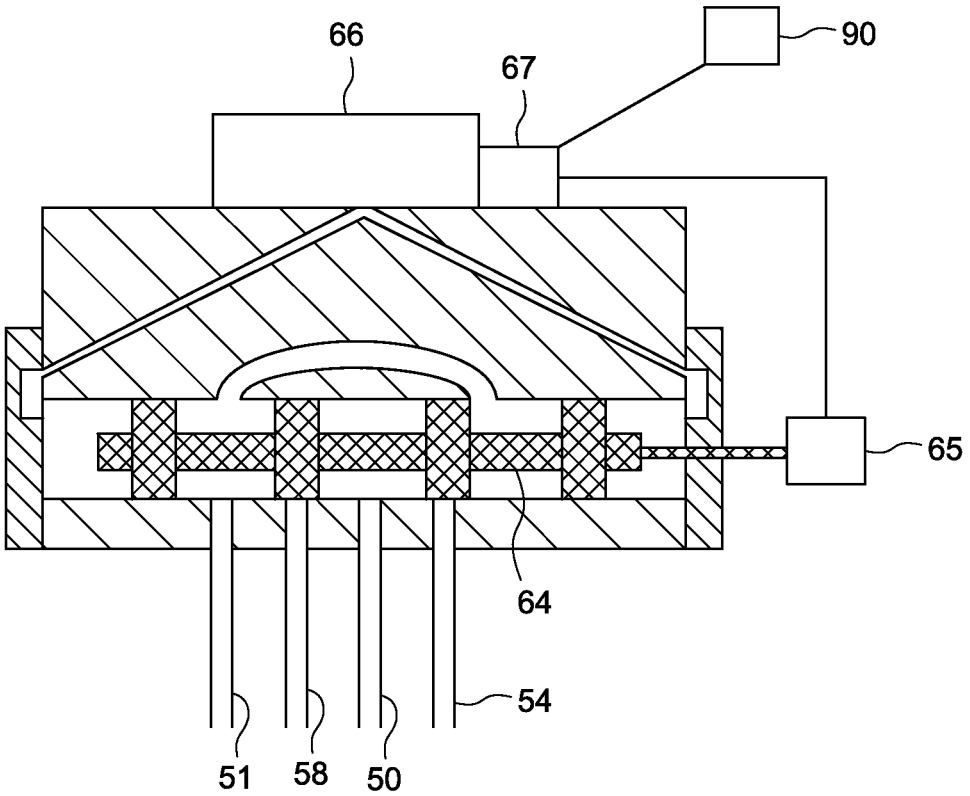
FIG. 1D is a cross section of the control valve in FIG. 1C.

FIG. 1C is a schematic of a four way, proportional directional control valve that may be used for each control valve 46. The control valve 46 has a valve body 62, a spool 64 and an actuator 66. The spool 64 has a series of lands and ports configured such that when the spool 64 is moved to the left or right different connections are made. FIG. 1D is an example of a possible internal configuration of a spool valve. In particular, the spool 64 is shown in FIG. 1D in position 2 of Table 1. Moving the spool 64 to the right puts the control valve 46 in position 1 of Table 1. Moving the spool 64 to the left puts the control valve 46 in position 3 of Table 1. While moving between position 2 and position 1, partially restricted flow paths are provided according to position 2. While moving between position 2 and positions 3, partially restricted flow paths are provided according to position 3.

The spool 64 is moved by the actuator 66. The spool 64 may move by sliding or rotating. The actuator 66 may be a mechanical actuator, a pilot-valve system, an electronic servo system or a combination of devices. The actuator 66 is connected to the controller 90 and moves the control valve 46 when instructed by the controller 90. Preferably, the actuator 66 includes an internal controller 67 that receives the instructions from the controller 90 and instructs the actuator 66 to move the control valve 46. The actuator 66 can move the spool 64 at a predetermined rate of speed. However, it is preferable for the controller 90 to control both the timing and rate of moving the spool 64. Varying the position of the spool 64 alters the velocity of the hydraulic cylinder 44. Varying the rate of movement of the spool 64 alters the acceleration or deceleration of the hydraulic cylinder 44. The control valve 46 preferably includes a spool position transducer 65, for example a linear variable differential transformer (LVDT), which feeds into a control loop within the internal controller 67 so that the position of the spool 64 can be adjusted if required to better match the position instructed by the controller 90 at a particular time. The rate of movement of the spool 64 may be implemented as a series of changes of position over time rather than as a rate directly.

The controller 90 preferably includes one or more programmable devices such as a processor or microprocessor, computer, Field Programmable Gate Array, or programmable logic controller (PLC). Alternatively or additionally, the controller 90 may comprise one or more non-programmable control elements, such as a timer or pneumatic or electric circuit, capable of implementing a sequence of operations. The controller 90 is preferably the same controller that is used to control the water cylinder valves 70 and the hydraulic pump 42. Optionally, multiple controllers may be used, preferably connected to a master controller.

Figure 2A:
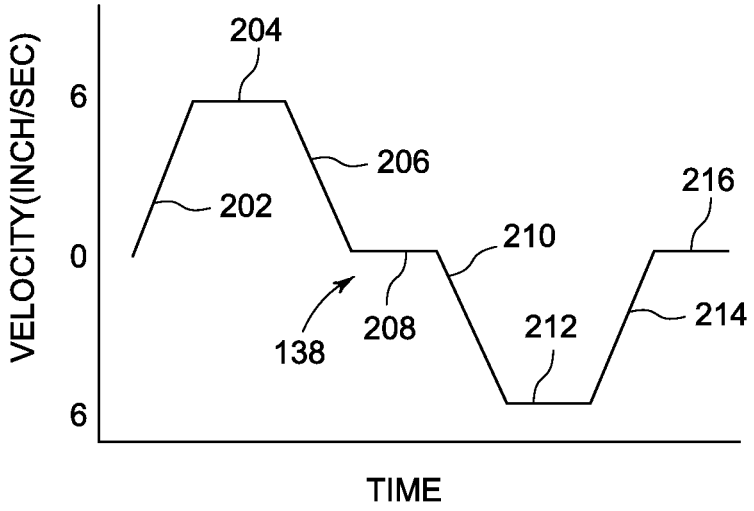
FIG. 2A is an intended water pump velocity profile for a single water pump.

FIG. 2A shows the velocity profile 138 of a single reciprocating assembly 26. The hydraulic piston 52 and piston rod 40 attached to this reciprocating assembly 26 follow the same velocity profile 138. In general, the reciprocating assembly 26 moves through a repeated cycle of movements. In each cycle, the reciprocating assembly 26 first moves in a forward direction, then stops for a dwell period, then moves in the reverse direction, then stops for a dwell period. The movement in the forward direction has an acceleration phase, a constant velocity phase and a deceleration phase. Similarly, the movement in the reverse direction has an acceleration phase, a constant velocity phase and a deceleration phase. For example, Table 2 shows the motions and positions (as defined in Table 1) of a control valve 46 during the cycle. With other valve sets 45, one or more valves are moved by the controller 90 as required to provide similar connections between the supply pipe 50 and the return pipe 51, and the forward feed pipe 54 and the reverse feed pipe 58, of a hydraulic cylinder 44.

TABLE 2

| Reference numeral (FIG. 2A) | Cycle phase | Control valve 46 movement or position |
|---|---|---|
| 202 | Accelerating forward | Moving from position 2 to position 1 |
| 204 | Constant velocity forward | Position 1 |
| 206 | Decelerating forward | Moving from position 1 to position 2 |
| 208 | Dwell | Position 2 |
| 210 | Accelerating reverse | Moving from position 2 to position 3 |
| 212 | Constant velocity reverse | Position 3 |
| 214 | Decelerating reverse | Moving from position 3 to position 2 |
| 216 | Dwell | Position 2 |

The cycle is implemented by the controller 90 moving the one or more valves of the valve set 45. For example, the controller 90 may have a velocity reference chart that represents the velocity profile 138, or a related position reference chart giving the desired position of the reciprocating assemblies 26 over time, or both. The velocity reference chart is pre-calculated and stored in the memory of the controller 90. The controller 90 is programmed to poll the velocity reference chart, for example at regular time intervals, to determine the required velocity at that time. At each time interval, the controller 90 instructs the valve set 45 to move one or more control valves 46, or hold one or more control valves 46 in position, as required. Accelerations and decelerations are caused by moving a control valve 46 between positions from one time interval to another. The required spool positions and changes in positions over time are obtained by the controller 90 referencing the velocity reference chart and sending instructions to the control valves 46 to move the spools 64 to positions of the spools 64 predicted, according to a chart or formula in the memory of the controller 90 relating reciprocating assembly 26 velocity to spool 64 position, to give the velocity of the reciprocating assemblies 26 specified for that time interval.

Figure 4:
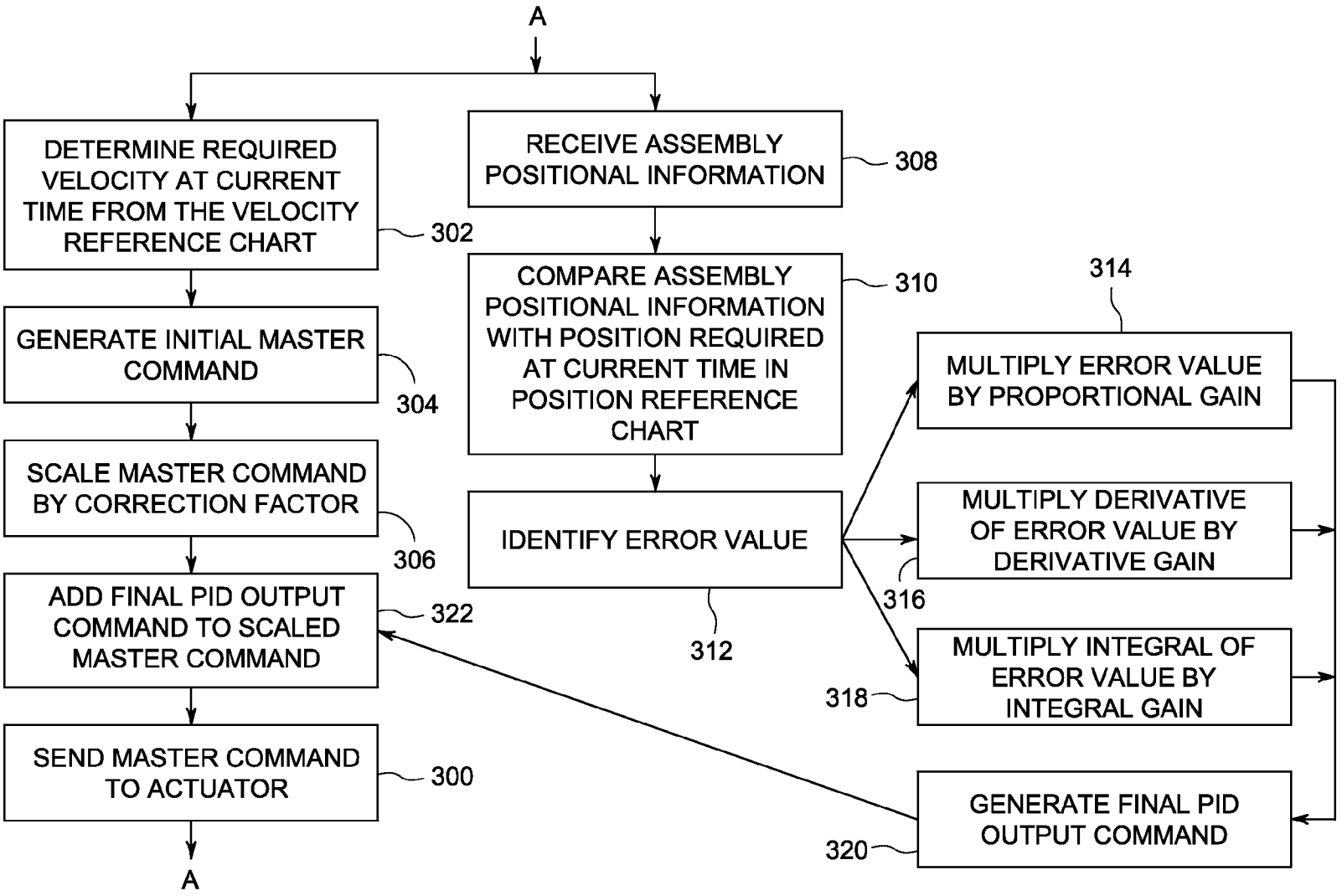
FIG. 4 is a schematic of a process for controlling a water treatment system as in FIG. 1.

In greater detail, and as depicted in FIG. 4, at each time interval the controller 90 instructs the actuator 66 to implement the required spool 64 positions by sending a master command to the internal controller 67, which in turn commands the actuator 66 of the control valve 46 (300) to move the spool 64 to the specified position. The controller 90 locates the required velocity by looking up the velocity value in the velocity reference chart that corresponds to current time (302). Current time may be indicated by a clock or timer in the controller 90. The controller 90 then determines what control valve 46 spool position should provide the required water cylinder velocity and generates an initial master command 304. The controller 90 can go through the process in FIG. 4 and send a master command to the internal controller 67 at a pre-determined frequency, for example once every 1 ms. Preferably, the master command is an electronic signal within a range of about −10 V and about 10 V. Each end of this signal range represents an instruction to move the control valve 46 to either the first or third position and a 0 V signal represents an instruction to move the control valve 46 to the second position.

The controller 90 receives information regarding the position of each reciprocating assembly 26 (308). For example, the controller 90 receives the positional information from an assembly position transducer 63 (shown in FIG. 1A) located on, or within, each reciprocating assembly 26, its associated piston rod 40 or the associated hydraulic piston 52. Optionally, the assembly position transducer 63 may be a LVDT sensor. The assembly position transducer 63 feeds into a control loop within the controller 90 so that the position of each reciprocating assembly 26 can be adjusted, if required, to better match a desired position profile of each reciprocating assembly 26, which is an integration of its velocity profile.

Figure 2B:
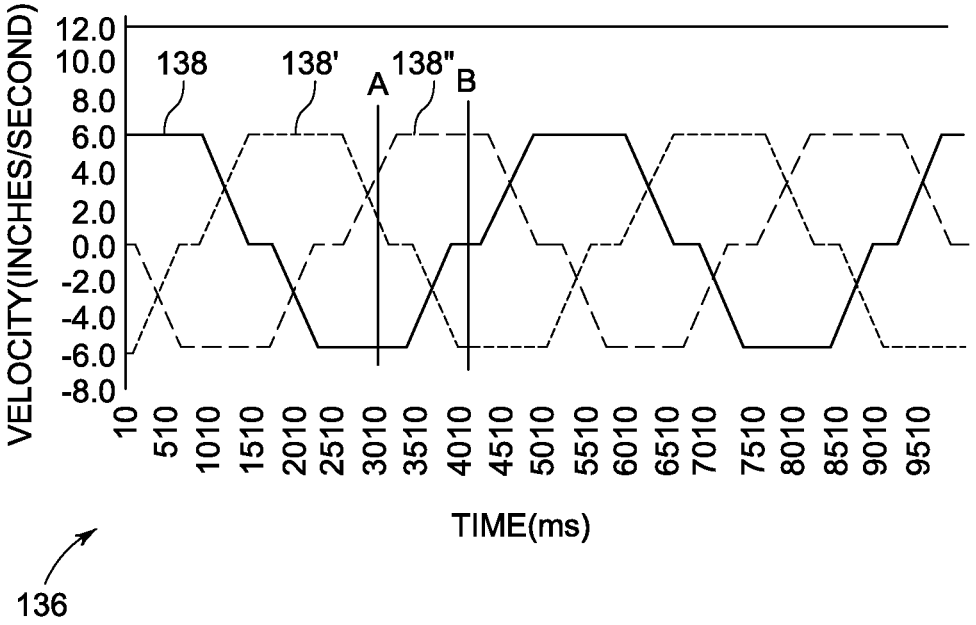
FIG. 2B is an intended water pump velocity profile for three water pumps.

FIG. 2B shows a desired assembly sequence 136. The assembly sequence 136 includes the velocity profiles 138, 138' and 138" of three reciprocating assemblies 26, 26', 26" over a period of time. The three velocity profiles 138, 138' and 138" are the same, but positioned out of phase, or with a relative time delay, such that the reciprocating assemblies 26, 26', 26" are not moving in the same direction at the same speed at the same time. Due to the operation of the water valves 70 described above, movement of a reciprocating assembly 26 in either direction produces a flow of feed water to the membrane unit 16. The sum of the absolute values of the velocities of the reciprocating assemblies 26, 26', 26" is generally constant. The feed flow rate to the membrane unit 16 is also generally constant. The sum of the flow rates of hydraulic fluid in supply pipes 50', 50" and 50'" is also generally constant. Similarly, the sum of the flow rates in return pipes 51', 51" and 51'"; the sum of the flow rates in forward feed pipes 54, 54' and 54'; and, the sum of the flow rates in reverse feed pipes 58', 58" and 58'" are also generally constant.

The controller 90 instructs the valve set 45 to implement the three velocity profiles 138, 138' and 138" in the phased relationship. Where the valve set 45 comprises three control valves 46, each control valve 46 moves through the same cycle but at different times. For example, at time A in FIG. 2B, control valve 46 is in, or close to, position 3; control valve 46' is moving from position 1 to position 2; and, control valve 46" is moving from position 2 to position 1. At time B in FIG. 2B, control valve 46 is in or close to position 2; control valves 46' is in or close to position 3 and control valve 46" is in or close to position 1.

During the velocity profile 138, there are four generally distinct pressures that occur within the system 10. The first pressure P1 is the pressure that supplies the feed water from the source 12 to the water cylinder 14. P1 can be provided by a variety of known pumps. The second pressure P2, which is higher than P1, is the pressure exerted on the feed water from the water cylinder 14 to the membrane unit 16. P2 is provided by the movement of the reciprocating assembly 26. The third pressure P3 is the pressure of the concentrate as it leaves the membrane unit 16 to return to the water cylinder 14. P3 is less than P2 since some of the energy is used to drive a filtration process of the membrane unit 16. The fourth pressure P4 is the pressure of the concentrate as it leaves the water cylinder 14 to the waste or recycling stream. P4 is less than P3. For example, P1 may be in the range of 5 to 100 p.s.i.; P2 may be in the range of 600 to 1000 p.s.i.; P3 may be in the range of 500 to 950 p.s.i.; and P4 may be in the range of 1 to 50 p.s.i.

Preferably, the controller 90 includes an independent proportional, integral and derivative (PID) loop for each control valve 46 (see FIG. 4). Each PID loop receives the positional information input from the assembly position transducer 63 and generates a PID output command that modifies the master command that the controller 90 sends to the associated control valve 46. Within each PID loop, the assembly positional information is compared against a stored position reference chart of an ideal position of the reciprocating assembly 26 during the assembly sequence 136 (310). The position reference chart is pre-calculated and stored in the memory of the controller 90. The comparison step identifies a positional error value 312 that is used to generate at least part of the PID output command by multiplying the positional error by a proportional gain term 314. Part of the PID output command can also be generated by multiplying an integral of the positional error, over time, with an integral gain term 316. The PID output command can also include a derivative of the positional error, over time, multiplied by a derivative gain term 318. The gain terms can be pre-calculated, based upon testing of the system 10, and saved in the memory of the controller 90. The three corrected signals of the multiplication steps are then summed to produce a final PID output command 320. The final PID output command is added to the master command, which may modify the master command 322. The final PID output command can increase or decrease the amplitude of the master command. The modified master command signal is sent from the controller 90 to the internal controller 67 to change the position of the spool 64. Optionally the PID loop may be based on positional information from the last time period rather than the current time period.

To allow for a PID output command indicating a more fully open valve position at any time, the position of each spool 64 may be between 80 and 98% open when the associated reciprocated assembly 26 is at maximum velocity specified in the velocity profile 138. This may be achieved by multiplying the master command by a further correction factor 306. This permits the spool 64 to move to a more open position and increase the flow of hydraulic fluid to the hydraulic cylinder 44 to correct the position or velocity of the reciprocating assembly 26 even if the reciprocating assembly 26 is already moving at the maximum velocity specified in the velocity profile 138.

Optionally, the positional information from the assembly position transducer 63 may be used to modify the output of the hydraulic pump 42. The positional information is received by the controller 90 and the positional information is mathematically transformed into a calculated change in hydraulic fluid flow rate through the control valve 46 that will be required to correct an error in position. The calculated change in hydraulic fluid flow rate is then multiplied by a proportional gain to provide a hydraulic command signal. The hydraulic command signal is sent to the hydraulic pump 42 to cause the pump to vary its output. For example, when the hydraulic pump 42 is a fixed displacement pump that is regulated by a variable frequency drive, the hydraulic command signal is sent to the variable frequency drive to change the hydraulic output. As another example, the hydraulic pump 42 can be an open circuit, pressure-compensated variable frequency pump with an internal control loop. The internal control loop includes a pump controller and a pressure sensor. The hydraulic command signal modifies a pressure threshold set-value within the pump controller so that when the pressure sensor senses an error between the actual pressure and the pressure threshold, the controller can change the hydraulic output to better match the pressure within the pump to the pressure threshold value. This altered hydraulic output also contributes to having the reciprocating assemblies 26, 26', 26" in the correct position and at the correct velocity during the cycle.

Preferably, the internal controller 67 receives spool positional information from the spool position transducer 65, which is compared with the instructed position provided by the last master command received. Any error between the spool positional information and the instructed position provides an error signal that is multiplied by a proportional gain to provide a new command signal. The new command signal is sent to the actuator 66 to move the spool 64 to, or closer to, the instructed position. The derivative and integral of the error signal can also be multiplied by individual gains and added to the new command signal to the actuator 66.

Figure 3:
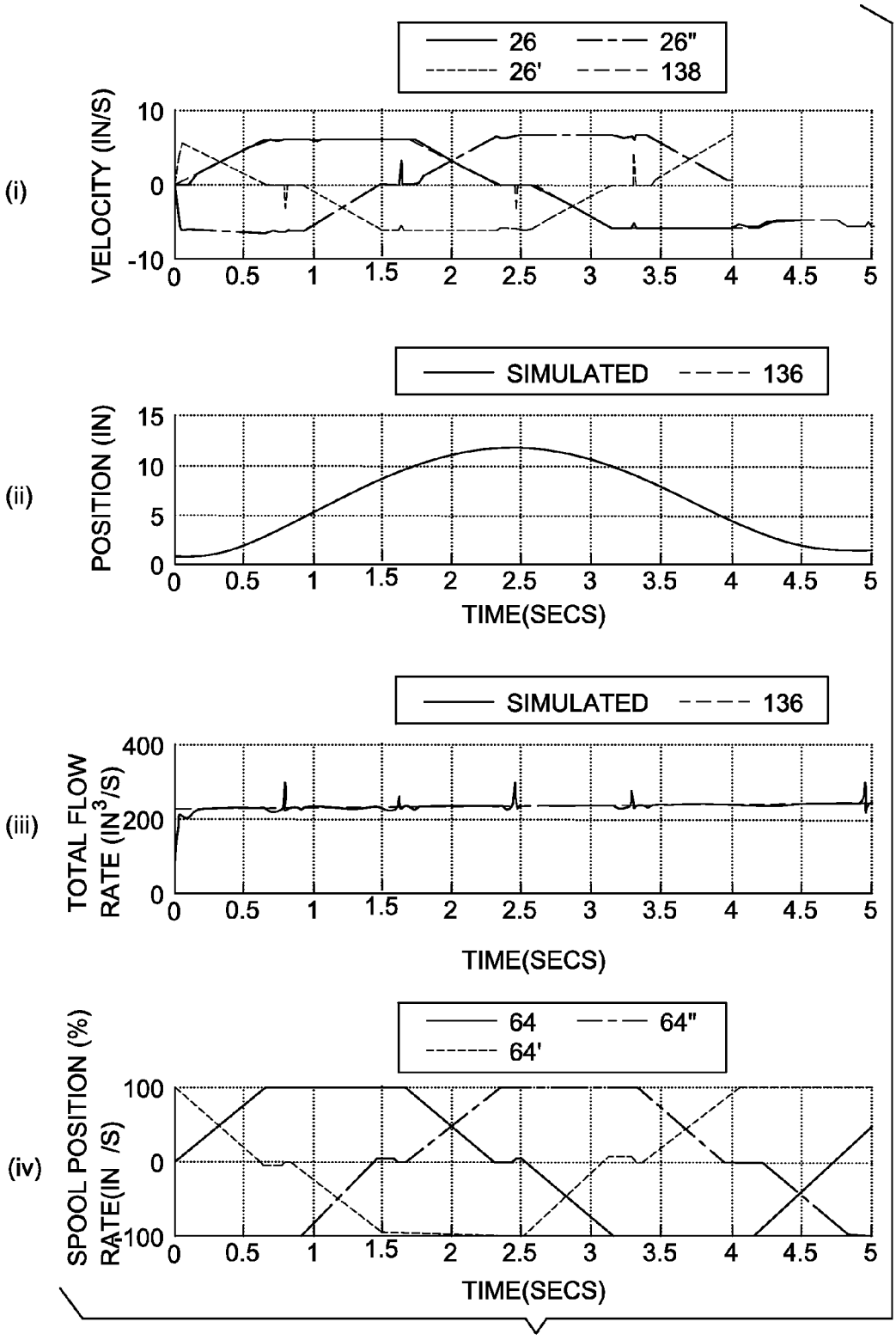
FIG. 3 depicts simulation results from computer modeling of the system of FIG. 1 in operation.

The system 10, with three water cylinders 14, 14', 14" and three, 4-way, 3-position proportional directional dual pilot control valves 46, was simulated with MATLAB/SIMULINK™ simulation software. FIG. 3 depicts the software modeling results. Panel (i) depicts the velocity (inches/second) of each reciprocating assembly 26, 26', 26" over time (seconds). Velocities in the range of 0 to 10 represent movement in the forward direction and the range of 0 to −10 represents movement in the reverse direction. The results indicate that the simulated reciprocating assembly 26" closely follows the assembly sequence 136. Panel (ii) depicts the simulated position (inches) over time (seconds) of one reciprocating assembly 26. The simulated position follows the assembly sequence 136 so closely that the lines are indiscernible. Panel (iii) depicts the total flow rate (inches$^3$/second) over time (seconds) of hydraulic fluid from hydraulic pump to the simulated three hydraulic cylinders 14, 14', 14" (collectively "simulated") and the ideal hydraulic flow rates. The results indicate that the simulated values closely follow the ideal values, which are scalable and reflect a constant flow of feed water to the membrane unit 16. Panel (iv) depicts the position of the spools 64, 64', 64" over time (seconds) with "0" representing the second position. The first position and the third position are represented by "100" and "−100", respectively.

Based upon computer simulations of the water treatment system, the system 10 has approximately 7% less specific power consumption than a system using three hydraulic pumps (one for each water cylinder) with swash plates. In the simulation, a significant portion of this difference was attributed to not idling hydraulic pumps during the dwell periods and the lack of an auxiliary parasitic charge pump that is used with swash-plate piston pumps.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art.

What is claimed is:

1. A liquid pumping system comprising, a) a plurality of liquid pumps;

b) a plurality of hydraulic cylinders, wherein each liquid pump is connected to a different hydraulic cylinder;

c) a valve set connected to the hydraulic cylinders, the valve set comprising a plurality of proportional directional control valves, each proportional directional control valve connected to a different hydraulic cylinder and having a first position wherein a supply pipe is in fluid communication with a first side of the connected hydraulic cylinder and a return pipe is in fluid communication with a second side of the connected hydraulic cylinder, a second position wherein the supply pipe and the return pipe are not in fluid communication with the hydraulic cylinder, and a third position wherein the supply pipe is in fluid communication with the second side of the connected hydraulic cylinder and the return pipe is in fluid communication with the first side of the connected hydraulic cylinder, and having a controllable transition speed between positions;

d) a hydraulic pump connected to the valve set, the hydraulic pump connected to the proportional directional control valves in parallel to provide an essentially constant flow of pressurized hydraulic fluid to the proportional directional control valves;

e) a plurality of sensors, each sensor configured to measure the position or velocity of a hydraulic piston of one of the hydraulic cylinders and provide information regarding the measured position or velocity of the hydraulic piston to a valve set controller; and, f) the valve set controller connected to the valve set to control the proportional directional control valves to distribute a flow of hydraulic fluid from the hydraulic pump between the hydraulic cylinders to operate the liquid pumps in a phased relationship by controlling each proportional directional control valve to cycle through a sequence comprising moving from the second position to the first position, dwelling in the first position, moving from the first position to the second position, dwelling in the second position, moving from the second position to the third position, dwelling in the third position, moving from the third position to the second position, and dwelling in the second position, and adjusting the proportional directional control valves based on the information regarding the measured position or velocity of each of the hydraulic pistons.

2. The liquid pumping system of claim 1 wherein the valve set controller is configured such that the total liquid flow produced from the liquid pumps is generally constant over a period of time in which the hydraulic pump produces a generally constant output.

3. The liquid pumping system of claim 1 wherein each liquid pump comprises one or more pistons.

4. The liquid pumping system of claim 3 wherein the one or more pistons are adapted to pump liquid on both a forward and a return stroke.

5. The liquid pumping system of claim 1 wherein the valve set controller includes an independent proportional, integral and derivative loop for each of the plurality of proportional directional control valves.

6. A membrane filtration system comprising, a) a liquid pumping system according to claim 1; and, b) a membrane unit.

7. The membrane filtration system of claim 6 comprising a water circuit configured such that each liquid pump receives pressurized brine from the membrane unit while pumping water.

8. A liquid pumping system comprising, a) a plurality of liquid pumps, each liquid pump comprising one or more pistons adapted to pump liquid on both a forward and a return stroke and wherein one or more pistons are connected to a connecting rod;

b) a plurality of hydraulic cylinders, each hydraulic cylinder comprising a hydraulic piston and a piston rod connected to the hydraulic piston, wherein a connecting rod of each liquid pump is connected to the piston rod of a different hydraulic cylinder, each hydraulic cylinder further comprising a rod extending in an opposite direction from the piston rod, the rod having a cross sectional area equal to or smaller than the piston rod;

c) a valve set connected to the hydraulic cylinders, the valve set comprising a plurality of proportional directional control valves, each proportional directional control valve connected to a different hydraulic cylinder and having a first position wherein a supply pipe is in fluid communication with a first side of the connected hydraulic cylinder and a return pipe is in fluid communication with a second side of the connected hydraulic cylinder, a second position wherein the supply pipe and the return pipe are not in fluid communication with the hydraulic cylinder, and a third position wherein the supply pipe is in fluid communication with the second side of the connected hydraulic cylinder and the return pipe is in fluid communication with the first side of the connected hydraulic cylinder, and having a controllable transition speed between positions;

d) a hydraulic pump connected to the valve set, the hydraulic pump connected to the proportional directional control valves in parallel to provide an essentially constant flow of pressurized hydraulic fluid to the proportional directional control valves;

e) a plurality of sensors, each sensor configured to measure the position or velocity of the hydraulic piston of one of the hydraulic cylinders and provide information regarding the measured position or velocity of the hydraulic piston to a valve set controller; and, f) the valve set controller connected to the valve set to control the proportional directional control valves to distribute a flow of hydraulic fluid from the hydraulic pump between the hydraulic cylinders to operate the liquid pumps in a phased relationship by controlling each proportional directional control valve to cycle through a sequence comprising moving from the second position to the first position, dwelling in the first position, moving from the first position to the second position, dwelling in the second position, moving from the second position to the third position, dwelling in the third position, moving from the third position to the second position, and dwelling in the second position, and adjusting the proportional directional control valves based on the information regarding the measured position or velocity of each of the hydraulic pistons.

9. The liquid pumping system of claim 8 wherein the valve set controller is configured such that the total liquid flow produced from the liquid pumps is generally constant over a period of time in which the hydraulic pump produces a generally constant output.

10. A membrane filtration system comprising, a) a liquid pumping system according to claim 8; and, b) a membrane unit.

11. The membrane filtration system of claim 10 comprising a water circuit configured such that each liquid pump receives pressurized brine from the membrane unit while pumping water.

12. The liquid pumping system of claim 8 wherein the valve set controller includes an independent proportional, integral and derivative loop for each of the plurality of proportional directional control valves.

* * * * *